United States Patent [19]

Eftefield

[11] 4,098,350

[45] Jul. 4, 1978

[54] BULLDOZER BLADE PUSH ARMS

[75] Inventor: Larry G. Eftefield, Chillicothe, Ill.

[73] Assignee: Caterpillar Tractor Co., Peoria, Ill.

[21] Appl. No.: 759,215

[22] Filed: Jan. 13, 1977

[51] Int. Cl.[2] ..... E02F 3/76

[52] U.S. Cl. ..... 172/776; 172/807; 52/731

[58] Field of Search ..... 172/801, 802, 803, 804, 172/805, 806, 807, 808, 809, 776; 52/731; 29/463, 155 R, 155 C; 280/106

[56] References Cited

U.S. PATENT DOCUMENTS

| | | | |
|---|---|---|---|
| 854,947 | 5/1907 | Hill | 52/731 |
| 1,974,520 | 9/1934 | Stewart | 172/801 |
| 2,115,913 | 5/1938 | Hicks | 280/106 |
| 2,861,812 | 11/1958 | Pilch | 280/106 R |
| 3,088,749 | 5/1963 | Schilberg | 52/531 |
| 3,293,822 | 12/1966 | Neuhoff | 29/155 R |
| 3,420,032 | 1/1969 | Felt | 52/731 |
| 3,509,679 | 5/1970 | Lindquist | 52/731 |

*Primary Examiner*—Richard J. Johnson
*Attorney, Agent, or Firm*—Phillips, Moore, Weissenberger, Lempio & Majestic

[57] ABSTRACT

A push arm for a bulldozer including a first C-shaped plate having a first base and first and second legs, and a second C-shaped plate having a second base and third and fourth legs, the first and second legs overlapping the third and fourth legs, respectively, at the outer sides of the third and fourth legs. Welds join the first and third legs and the second and fourth legs at the overlap. A bracket for supporting a tilt cylinder to tilt the blade includes fifth and sixth legs straddling, respectively, the outsides of the third and fourth legs and connected to the first and second legs by other welds.

14 Claims, 3 Drawing Figures

BULLDOZER BLADE PUSH ARMS

BACKGROUND OF THE INVENTION

This invention relates to a high strength frame coupling together two members and, more particularly, to a high strength push arm assembly connecting a tractor to a bulldozer blade.

Conventional bulldozers include push arms connected at one end to a tractor and at another end to a blade. The push arms are usually heavy, hollow beams extending from a hinged connection on the tractor to the bottom of the blade. These arms push the blade into the ground for digging or pushing the dirt. In one type of bulldozer, the blade is tiltable by use of a hydraulic jack or tilt cylinder which imparts a raising or lowering motion to one end of the blade relative to the other, thereby giving the blade what is known as tilt. Typically, the hydraulic jack is connected at one end to a bracket which is supported on a push arm and at the other end to the blade. Additionally, a tilt brace is connected to the blade and a second bracket which is supported on a second push arm to hold the blade in a tilted or upright position.

In view of the high forces acting on the push arm when the dirt is being moved, the push arms must be very strong to absorb these forces without fracturing or breaking. In one example, the push arm can be composed of a single piece which has the advantage of being relatively strong; however, such single piece construction is relatively expensive to manufacture. Consequently, use is also made of a push arm having two C-shaped plates which are welded together to form a box channel. The two C-shaped plates typically are welded together at the upper and lower surfaces of the push arm, with the brackets for the tilt cylinder and tilt brace being welded on this top surface. While this two-piece push arm construction is less expensive to manufacture than the single-piece construction, failures have been encountered and have been analyzed as resulting from the concentration of stresses at the top and bottom surfaces of the push arms where the welds are made. Consequently, it has been a problem to employ a push arm which is both inexpensive to manufacture and of high strength.

SUMMARY OF THE INVENTION

The present invention is directed to overcoming one or more of the problems as set forth above. According to the present invention, the push arm includes two C-shaped plates which are welded together at areas of low stress. Also, the brackets for the hydraulic jack and the tilt brace are welded to the push arm at areas of low stress. More particularly, there are no welds on the upper surface of the push arm, but rather, the welds are made at the sides of this push arm. The brackets straddle the push arms and are welded at these sides. Thus, by positioning the welds in areas of low stress, the present invention overcomes failures experienced in prior structures in which the welds were placed at areas of relatively higher stress.

DETAILED DESCRIPTION OF THE DRAWINGS

Figure 1:
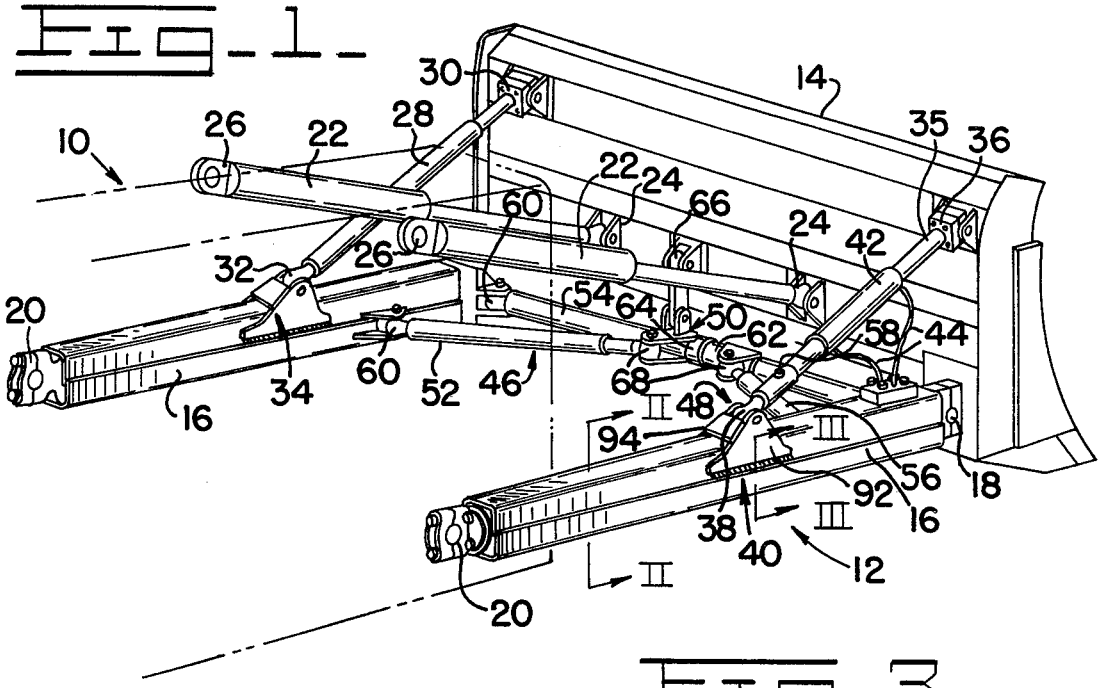
FIG. 1 is a perspective view of a bulldozer assembly showing the push arms and blade tilting assembly.

FIG. 1 shows a tractor 10 fitted with a bulldozer assembly 12 which includes a blade 14 connected to a pair of push arms 16 at forward points 18 on either side of the blade 14. Rear ends 20 are pivotally mounted to the tractor 10 by pivot means (not shown). A pair of hydraulic jacks 22 are connected at their forward ends 24 to the blade 14 and at their rearward ends 26 to the tractor by means (not shown), to raise and lower the blade in a well-known manner.

A first tilt brace 28 is connected at its forward end 30 to the blade 14 and at its rearward end 32 to a bracket 34 mounted to one push arm 16. Another tilt brace 35 is mounted at its forward end 36 to the blade 14 and at its rearward end 38 to another bracket 40 mounted to the other push arm 16. Tilt brace 35 includes a hydraulic jack or tilt cylinder 42 capable of operation in a well-known manner from the tractor operator's station through hydraulic lines 44 to vary the length of the brace 35, thereby imparting a raising or lowering motion to the lower corner of the blade 14 to tilt the blade.

Each push arm 16 has a brace assembly 46 or 48 extending toward the central portion 50 of the blade 14. Brace assembly 46 comprises two struts 52,54 and brace assembly 48 comprises two struts 56,58. All of the struts 52,54,56,58 are connected to the push arms 16 by identical pivot joints 60, though only the two joints for the brace 46 are visible. The inner ends of the struts 56,58 are associated with a block 62, and the inner ends of the struts 52,54 are connected with a block 64. The inner ends of struts 54 and 58 are rigidly connected with the blocks 64 and 62, respectively, and the blocks 62,64 are interconnected by a sliding and swivel joint (not shown) well known in the art. This swivel joint enables the brace assemblies 46 and 48 to move slightly to and away from the blade 14 while they are restrained from vertical movement by a link 66. The inner ends of struts 52 and 56 are connected with their respective blocks 64,62 by identical pivotal connections 68. A more complete description of the brace assemblies 46 and 48, as well as their connections to the blade 14 and their function is given in U.S. Pat. No. 3,395,764, issued Aug. 6, 1968 in the name of Leon A. Wirt.

Figure 2:
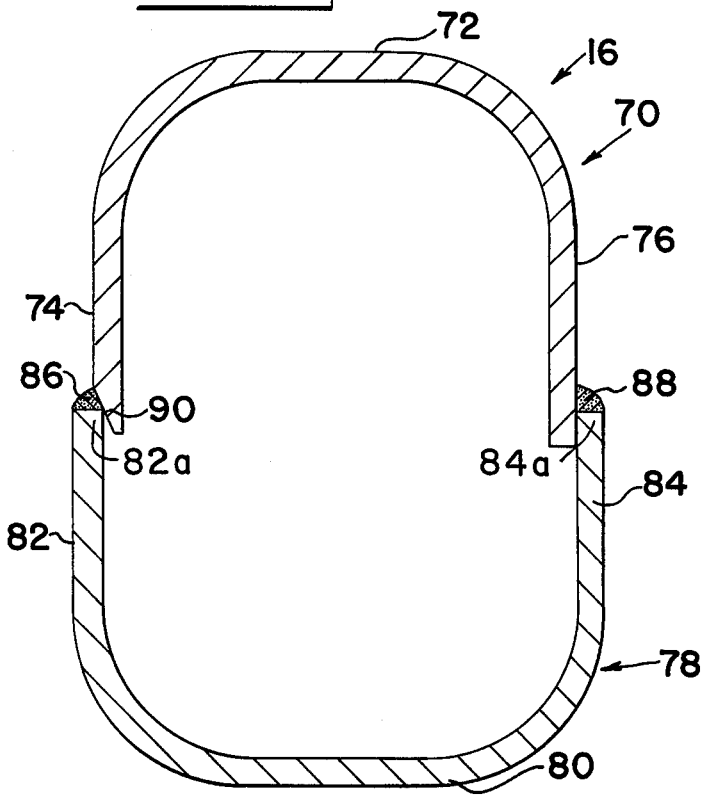
FIG. 2 is a section of the push arms taken along lines 2—2 of FIG. 1.

FIG. 2 illustrates the push arms 16 in more detail. The push arms 16 include a C-shaped plate 70 having a base 72 and downwardly extending legs 74,76. The push arms 16 are also formed by another C-shaped plate 78 having a base 80 and two legs 82,84 extending upwardly from the base 80. The legs 82 and 84 overlap the legs 74 and 76, respectively, at the outer sides of the latter. Fillet welds 86 and 88 are provided at the overlap on either side of the push arms 16, particularly at the top ends **82*a* and 84*a* of the legs 82 and 84, to connect legs 74 and 82 on the one hand and legs 76 and 84 on the other hand. Leg 74 has chamfer 90 at its lower end and the upper end of leg 82 contacts this chamfer 90 to provide a wedge fit between the C-shaped plates 70 and 78 prior to welding. This produces a better fit than would otherwise be possible without this wedging action. The plates 70 and 78** may be constructed of a high strength steel.

Figure 3:
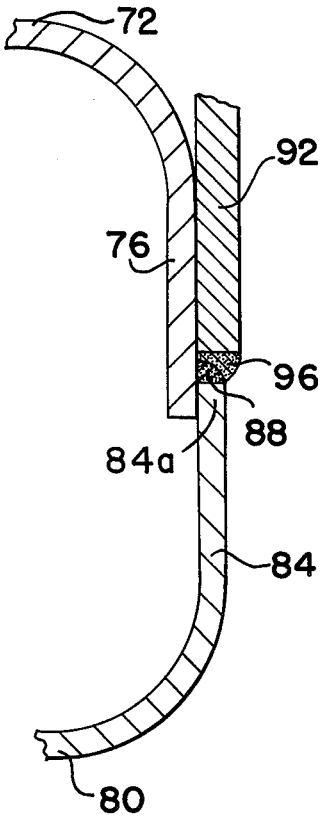
FIG. 3 is a section of the push arms and tilt cylinder mounting bracket taken along the lines 3—3 of FIG. 1.

FIG. 3 illustrates the connection of the bracket 34 or 40 to the push arms 16. The bracket 40 shown in FIG. 3 has a leg 92, which is drawn partially broken away, straddling the outside surface of the leg 76. Similarly, bracket 40 has another leg 94 (see FIG. 1) straddling the outside of leg 74. Each of the legs of the brackets 34 and 40, such as leg 92, is welded at 96 to the weld 88 and to the corresponding leg 76.

It will be appreciated from the above that there are no welds on the bases 72 and 80 which correspond to the upper and lower surfaces of the push arms 16; these surfaces normally are subjected to relatively high stress. Also, the bases 72 and 80 are substantially of uniform cross-section and have no discontinuities in them, i.e., they constitute a single piece construction. Consequently, the high stresses acting on these bases will be less likely to cause a fracture or failure of the push arms 16. All the welds 86,88 and 96 required for joining the C-shaped sections 70 and 78 together and the brackets 34 and 40 to the push arms 16 extend along the mid-sides of the push arms where there are relatively low stresses. Consequently, by positioning these welds in areas of low stress, the likelihood of the push arms to fail or fracture is greatly reduced.

While the invention has been particularly shown and described with reference to a preferred embodiment thereof, it will be understood by those skilled in the art that the foregoing and other changes in form and details may be made therein without departing from the spirit and scope of the invention.

The embodiments of the invention in which an exclusive property or privilege is claimed are defined as follows:

1. A frame, comprising:

(a) a first, elongated C-shaped plate having a first base and first and second legs, (b) a second, elongated C-shaped plate having a second base and third and fourth legs, said first and second legs overlapping said third and fourth legs, respectively, wherein one leg of only one pair of said first and third legs or said second and fourth legs has a chamfer to form a wedge fit between said legs of said one pair; and (c) a weld joining said first and third legs and said second and fourth legs where said legs overlap.

2. A frame according to claim 1 wherein said weld is a fillet weld.

3. A frame according to claim 1 wherein said first plate defines a lower channel with said first and second legs extending upwardly from said first base, and said second plate defines an upper channel with said third and fourth legs extending downwardly from said second base.

4. A frame according to claim 3 wherein said third leg has said chamfer at the overlap and said first leg contacts said chamfer to form said wedge fit between said first and third legs.

5. A frame according to claim 3 further comprising a bracket having fifth and sixth legs straddling, respectively, the outsides of said third and fourth legs and welded, respectively, on top ends of said first and second legs and to said third and fourth legs.

6. A push arm assembly for connecting a bulldozer blade to a tractor, comprising:

(a) a first, elongated C-shaped plate defining a lower channel, including a first, horizontally extending base and first and second legs extending upwardly from said first base;

(b) a second, elongated C-shaped plate defining an upper channel, including a second, horizontally extending base and third and fourth legs extending downwardly from said second base, said first and second legs overlapping, respectively, said third and fourth legs, wherein one leg of only one pair of said first and third legs or said second and fourth legs has a chamfer to form a wedge fit between said legs of said one pair; and (c) a first weld joining said first and third legs and said second and fourth legs where said legs overlap.

7. A push arm assembly according to claim 6 wherein said first leg overlaps the outside of said third leg and said second leg overlaps the outside of said fourth leg.

8. a push arm assembly according to claim 6 further comprising a bracket means for coupling a brace to said blade and said assembly, said bracket means including fifth and sixth legs straddling, respectively, the outsides of said third and fourth legs and connected, respectively, to said first and second legs.

9. A push arm assembly according to claim 8 wherein said fifth and sixth legs are connected to said first and second legs by a second weld.

10. A push arm assembly according to claim 9 wherein said first and second welds are contiguous.

11. A push arm assembly according to claim 6 wherein said first weld is a fillet weld.

12. A push arm assembly according to claim 6 wherein said third leg has said chamfer, and said first leg contacts said third leg at said chamfer to provide said wedge fit.

13. A frame comprising:

(a) a first elongated C-shaped plate defining a lower channel and having a first base and first and second legs extending upwardly from said first base, said first and second legs having top ends;

(b) a second, elongated C-shaped plate defining an upper channel and having a second base and third and fourth legs extending downwardly from said second base, said third and fourth legs overlapping inner sides of said top ends of said first and second legs; and (c) bracket means for supporting a member, including fifth and sixth legs straddling, respectively, the outsides of said third and fourth legs and welded, respectively, on said top ends of said first and second legs and to said third and fourth legs.

14. A push arm assembly for connecting a bulldozer blade to a tractor, comprising:

(a) a first, elongated C-shaped plate defining a lower channel and having a first, horizontally extending base and first and second legs extending upwardly from said first base, said first and second legs having top ends;

(b) a second, elongated C-shaped plate defining an upper channel and having a second, horizontally extending base and third and fourth legs extending downwardly from said second base, said third and fourth legs overlapping inner sides of said top ends of said first and second legs; and (c) bracket means for coupling a brace to the blade and to said first and second legs, including fifth and sixth legs straddling, respectively, the outsides of said third and fourth legs and welded, respectively, on said top ends of said first and second legs and to said third and fourth legs.

* * * * *